US010988341B1

(12) United States Patent
Curran

(10) Patent No.: US 10,988,341 B1
(45) Date of Patent: Apr. 27, 2021

(54) REEL GRIPPING DEVICE

(71) Applicant: Robert R. Curran, Alamogordo, NM (US)

(72) Inventor: Robert R. Curran, Alamogordo, NM (US)

( * ) Notice: Subject to any disclaimer, the term of this patent is extended or adjusted under 35 U.S.C. 154(b) by 0 days.

(21) Appl. No.: 16/747,177

(22) Filed: Jan. 20, 2020

(51) Int. Cl.
*B66D 1/34* (2006.01)
*B65H 75/28* (2006.01)

(52) U.S. Cl.
CPC ..... *B65H 75/285* (2013.01); *B66D 1/34* (2013.01)

(58) Field of Classification Search
CPC ... B66D 1/34; B66D 1/36; B66D 1/38; B65H 75/285
See application file for complete search history.

(56) References Cited

U.S. PATENT DOCUMENTS 1,646,593 A 10/1927 Peterson
2,267,335 A * 12/1941 Kiessling ..... B65H 75/285 206/53
2,301,392 A * 11/1942 Funke ..... B65H 75/285 206/53
2,421,788 A 6/1947 Henry
2,831,299 A 4/1958 Keeble
2,846,162 A * 8/1958 Allin, Sr. ..... B66D 1/34 242/586.1
3,195,722 A 7/1965 Duden
3,481,557 A * 12/1969 Miller ..... B66D 1/30 242/395
4,053,120 A 10/1977 Frantzreb, Sr.
4,210,295 A 7/1980 Brusselle
4,850,487 A 7/1989 Robertson
5,150,790 A 9/1992 Forgette
5,238,113 A 8/1993 Parrott et al.
5,664,766 A * 9/1997 Baziuk ..... B66D 1/34 254/375
6,981,670 B2 1/2006 Harrington
7,357,252 B2 4/2008 Franks
10,807,841 B2 * 10/2020 Mupende ..... B66D 1/30
2006/0131458 A1 * 6/2006 Hendry ..... B65H 75/26 242/397

* cited by examiner

*Primary Examiner* — Sang K Kim
(74) *Attorney, Agent, or Firm* — Cramer Patent & Design, PLLC; Aaron R. Cramer

(57) ABSTRACT

A reel griping device includes a clamp capable of being removably secured to an end of a spool of heavy gauge wire. At a first end of the clamp is an adjustable wire securing device which utilizes a pair of springs to bias a pair of respective jaws against the unit of wire being fed from the spool through the device. There exist different embodiments to provide an adjustment means to the clamping force.

4 Claims, 6 Drawing Sheets

REEL GRIPPING DEVICE

RELATED APPLICATIONS

None.

FIELD OF THE INVENTION

The present invention relates generally to a reel gripping device.

BACKGROUND OF THE INVENTION

There is a great deal of linear goods such as flexible pipe, flexible conduit, rope, cable, wire, and the like that are shipped on reels. These reels vary in size from a few inches up to ten (10) feet or more. When such goods are shipped from the factory, the loose end on the exterior of the reel is semi permanently fastened down such as by a strap, nail, fastener, exterior cladding on the reel or the like ensuring that the end remains in place and does not unravel. However, when a length of product is cut free, it is difficult to refasten this loose end. Thus, it hangs loose causing the balance of product on the reel to become loose and unravel as well. This not only leads to damaged product that may have to be discarded, but also represents a safety hazard as well as lost labor time trying the keep the loose end secured as well as lost time looking for it when needed. Accordingly, there exists a need for a means by which the loose end of a linear product stored on a reel can be secured once product is removed and cut from the reel in an effort to address the problems as described above. The development of the reel gripping device fulfills this need.

SUMMARY OF THE INVENTION

In view of the foregoing references, the inventor recognized the aforementioned inherent problems and observed that there is a need for a clamp mounted to an exterior perimeter of a flange of a reel, comprises a securing clamp securing a loose end of a linear product wound on the reel within the securing clamp. The securing clamp includes a rectangular frame with an interior opening through which the loose end of a linear product passes and is restrained from unwinding or becoming loose. The securing clamp includes a pair of swing clamps that move along a plurality of spring-loaded pivot points to produce a dual arc travel path to allow the loose end to be drawn through the securing clamp. The clamp also comprises an attachment clamp attached to the securing clamp. The attachment clamp is secured to the exterior perimeter of the flange of the reel. The attachment clamp includes an interior plate and an exterior plate secured to each other by a pair of clamping mechanisms. The pair of clamping mechanisms serve to keep the interior plate and the exterior plate in a parallel arrangement. The clamp also comprises a swivel joint which is incorporated as part of a junction between the securing clamp and the attachment clamp and a grip handle which aids in opening the pair of clamping mechanisms in place to accommodate different thicknesses of the flange.

Any attempt by the loose end to retract away may cause the loose end to become bound with the interior opening between the swing clamps and prevent retraction. The loose end may be routed through the interior opening of the rectangular frame of the securing clamp, whereupon it is secured in place to prevent unwinding or unraveling. The clamping mechanisms may accommodate the flange of a thickness in the range of one inch to two-and-a-half inches. The interior plate and the exterior plate may be provided with a gripping aid to aid in the gripping of the flange. The gripping aid may be a plurality of machined grooves. The pair of clamping mechanisms may be secured by a plurality of fasteners. The swivel joint may accommodate a first range of motion of three hundred sixty-degrees perpendicular to the clamping face and a second range of motion of ninety-degrees parallel to the clamping face. The second range of motion may be aided by an internal spring.

The clamp mounted to an exterior perimeter of a flange of a reel may also comprise a securing clamp securing a loose end of a linear product wound on the reel within the securing clamp. The securing clamp may include a rectangular frame with an interior opening through which the loose end of a linear product passes and is restrained from unwinding or becoming loose. The clamp may also comprise a swivel joint which is incorporated as part of a junction between the securing clamp and the attachment clamp and an opening formed by a movable plate and a stationary plate. The movable plate is positioned by a pair of guide rods. The clamp also comprises a pair of springs which force the movable plate towards the stationary plate via travel along the guide rods to secure the loose end along a closing travel path.

To open the securing clamp to release the loose end, a user would grab a release bar and pull along an opening travel path, a portion of the release bar passes through the rectangular frame and is attached to the movable plate. The pair of springs are attached to the movable plate and the inner surface of the rectangular frame and circumscribe a portion of the guide rods. The positing of the guide rods is adjacent the inner surfaces of the rectangular frame, thus providing an adequate area for the loose end to be secured therein.

The pair of clamping mechanisms may be secured by a plurality of fasteners. The swivel joint may accommodate a first range of motion of three hundred sixty-degrees perpendicular to the clamping face and a second range of motion of ninety-degrees parallel to the clamping face. The second range of motion is aided by an internal spring.

A clamp mounted to an exterior perimeter of a flange of a reel may also comprise a securing clamp securing a loose end of a linear product wound on the reel within the securing clamp. The securing clamp includes a rectangular frame with an interior opening through which the loose end of a linear product passes and is restrained from unwinding or becoming loose. This clamp also comprises a swivel joint incorporated as part of a junction between the securing clamp and the attachment clamp and an opening formed by a movable plate and a stationary plate. The second movable plate is held in place by a pair of tracks on either side of the rectangular frame. The movable plate is driven along an open/close travel path by turning a thumbscrew along a rotational travel path.

The pair of clamping mechanisms may be secured by a plurality of fasteners. The swivel joint may accommodate a first range of motion of three hundred sixty-degrees perpendicular to the clamping face and a second range of motion of ninety-degrees parallel to the clamping face. The second range of motion may be aided by an internal spring.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
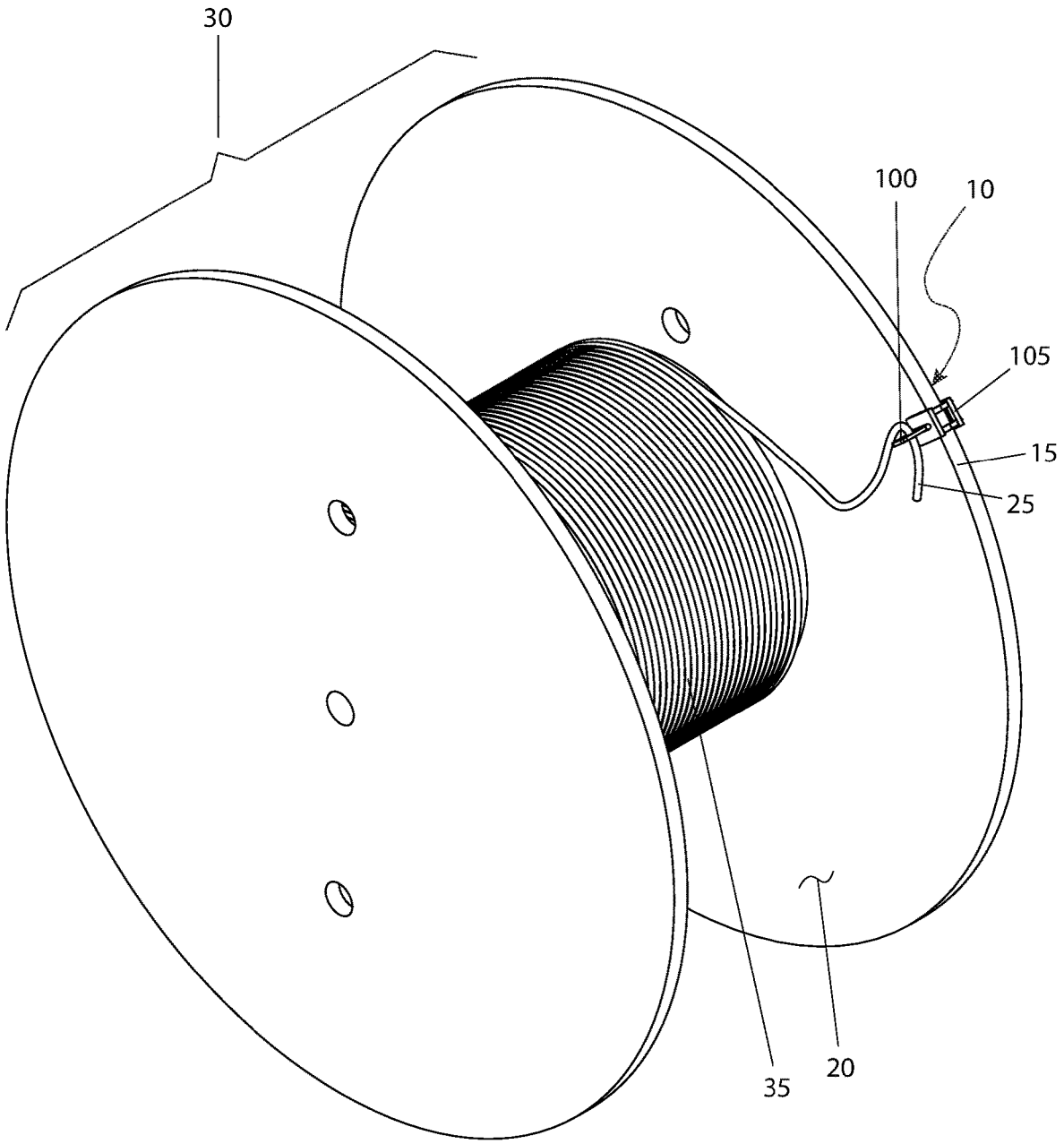
FIG. 1 is a perspective view of the clamp 10, shown in a utilized state on a reel 30, according to the preferred embodiment of the present invention.

10 clamp
15 perimeter
20 flange
25 loose end
30 reel
35 linear product
100 securing clamp
105 attachment clamp
110 interior plate
115 exterior plate
120 clamping mechanism
125 swivel joint
126 three hundred sixty-degree) (360°) range of motion "e"
127 ninety-degree) (90°) range of motion "b"
128 gripping aid
130 rectangular frame
135 opening
140 fastener
145 grip handle
150 swing clamp
155 spring-loaded pivot point
160 arc travel path "a"
161 internal spring
165 first alternate securing clamp
170 first movable plate
175 first stationary plate
180 guide rod
185 spring
190 closing travel path "c"
195 release bar
200 opening travel path "o"
205 second alternate securing clamp
210 second movable plate
215 second stationary plate
220 tracks
225 open/close travel path "oc"
230 thumbscrew
235 rotational travel path "r"
240 threaded shaft

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a perspective view of the clamp 10, shown in a utilized state on a reel 30, according to the preferred embodiment of the present invention is disclosed. The clamp 10 (herein also described as the "clamp") 10, is mounted to the exterior perimeter 15 of the flange 20. A loose end 25 of a linear product 35 wound on the reel 30 is secured within a securing clamp 100 and is thus restrained from unwinding or becoming loose. The securing clamp 100 is physically attached to an attachment clamp 105 which is secured to the perimeter 15. The clamp 10 would be made in multiple sizes for use on reels 30 that vary in size from a few inches up to tens of feet that are constructed from a wide variety of material such as wood, steel, plastic, aluminum or the like. As such, the use of the clamp 10 on any particular size of reel 30 or material of construction used on the reel 30 is not intended to be a limiting factor of the present invention.

The clamp 10 can be used with a wide variety of linear products 35 including, but not limiting to: tubing, flexible pipe, flexible conduit, cable, wire, rope, or chain. As such, the use of clamp 10 with any particular type of linear product 35 is not intended to be a limiting factor of the present invention.

Figure 2:
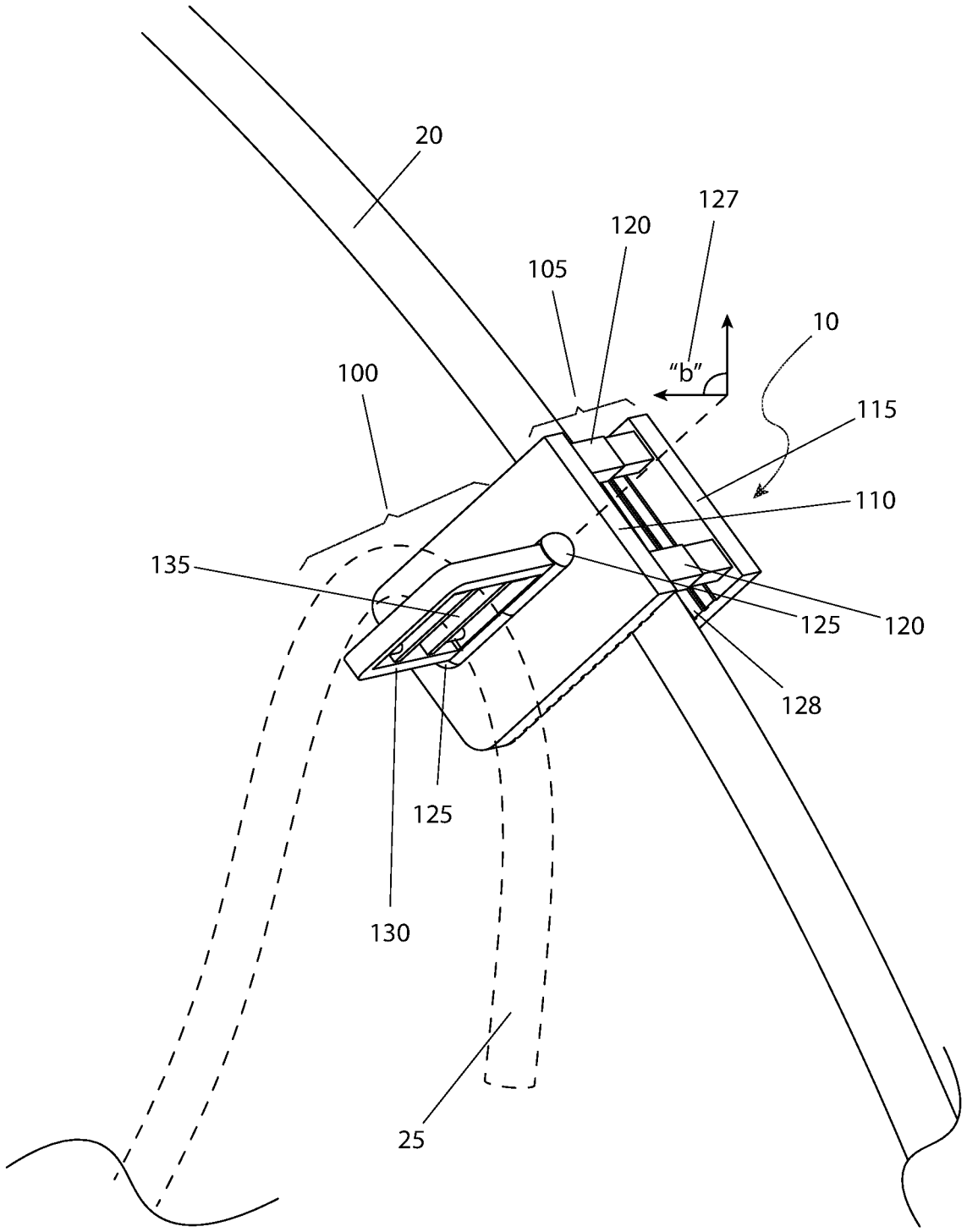
FIG. 2 is a front perspective view of the clamp 10, shown in a utilized state, according to the preferred embodiment of the present invention.

Referring next to FIG. 2, a front perspective view of the clamp 10, shown in a utilized state, according to the preferred embodiment of the present invention is depicted. This view depicts the securing clamp 100 in an attached state to the attachment clamp 105 which is in turn clamped to the flange 20. The attachment clamp 105 comprises an interior plate 110 and an exterior plate 115, secured to each other by two (2) clamping mechanisms 120. The clamping mechanisms 120 are envisioned to accommodate flanges 20 of a thickness of one (1) inch (1 in.) to two-and-a-half inches (2½ in.). A swivel joint 125 may be incorporated as part of the junction between the securing clamp 100 and the attachment clamp 105. The swivel joint 125 accommodates a three hundred sixty-degree (360°) range of motion "e" 126 perpendicular to the clamping face, and a ninety-degree (90°) range of motion "b" 127 parallel to the clamping face. The securing clamp 100 includes a rectangular frame 130 with an interior opening 135 through which the loose end 25 passes. Both the interior plate 110 and an exterior plate 115 are provided with a gripping aid 128, such as machined grooves, to aid in the gripping of the flange 20. Further description on the securing clamp 100 will be provided herein below.

Figure 3:
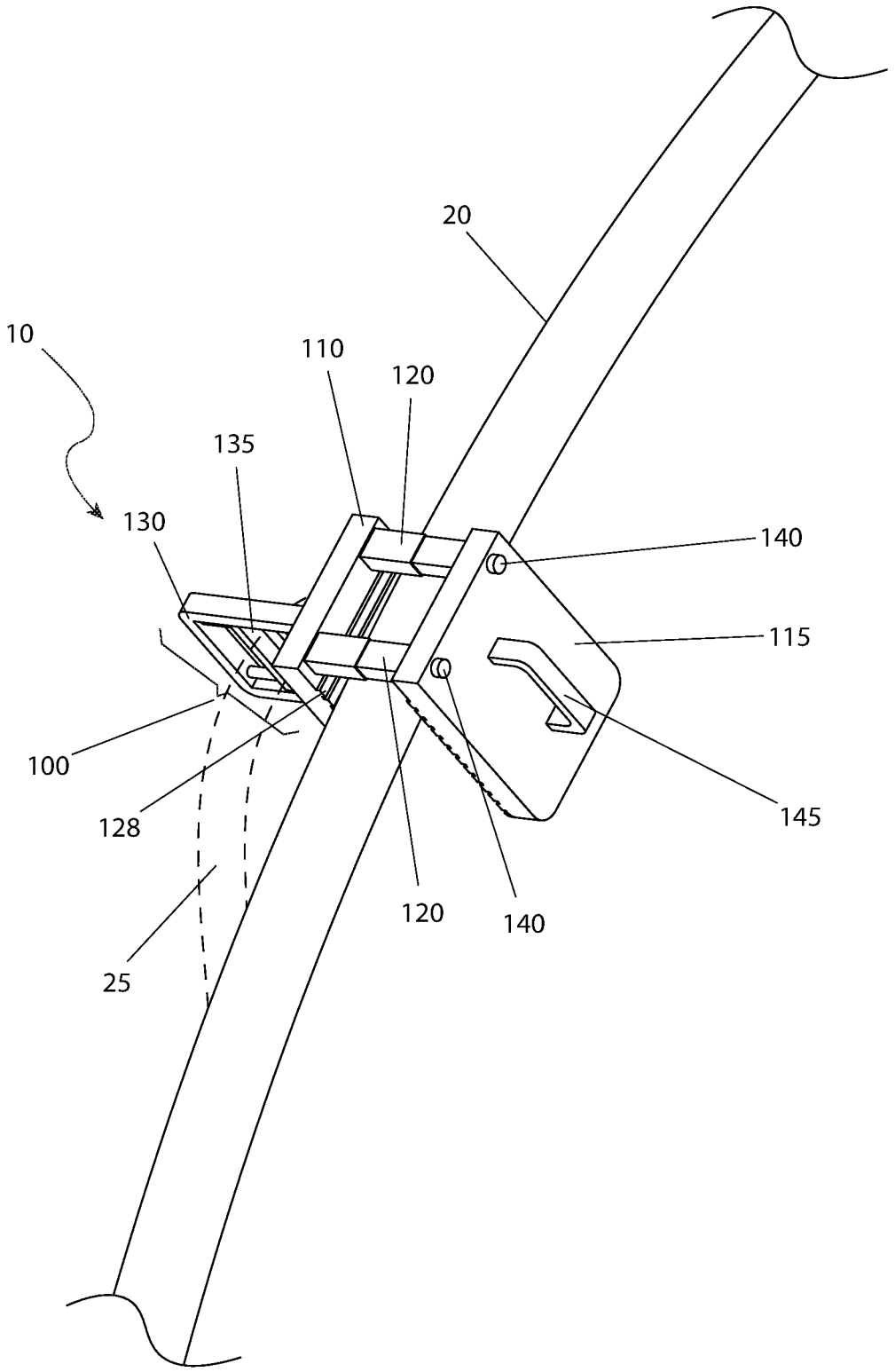
FIG. 3 is a rear perspective view of the clamp 10, shown in a utilized state, according to the preferred embodiment of the present invention.

Referring now to FIG. 3, a rear perspective view of the clamp 10, shown in a utilized state, according to the preferred embodiment of the present invention, is shown. This view discloses the loose end 25 routed through the opening 135 of the rectangular frame 130 of the securing clamp 100, whereupon it is secured in place to prevent unwinding or unraveling. The two (2) clamping mechanisms 120 are secured by fasteners 140. A grip handle 145 aids in opening the clamping mechanisms 120 in place to accommodate different thicknesses of the flange 20. The clamping mechanisms 120 also serve to keep the interior plate 110 and the exterior plate 115 in a parallel arrangement. The gripping aid 128 is visible upon the inside surface of the interior plate 110.

Figure 4:
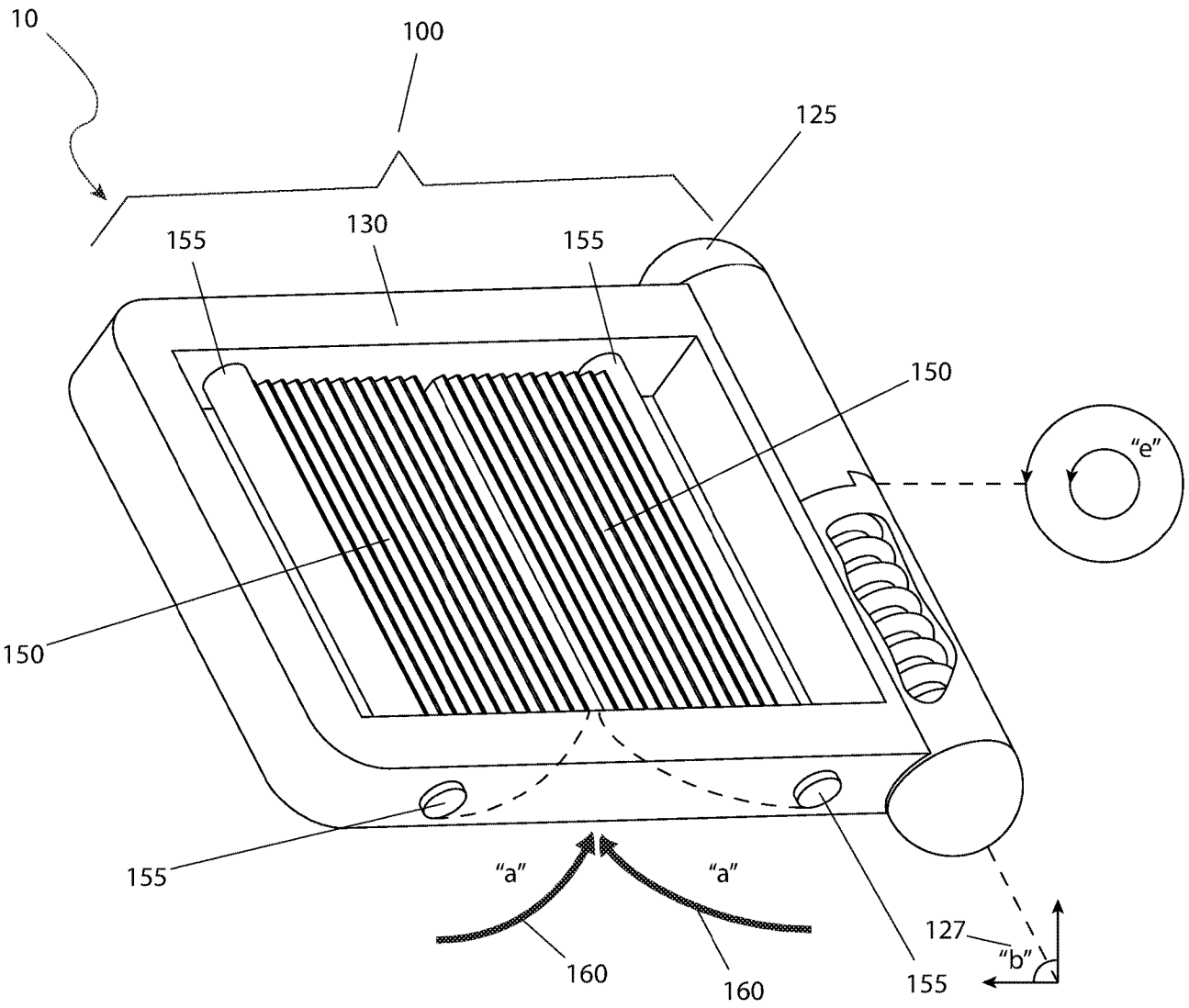
FIG. 4 is a detailed perspective view of the securing clamp 100, as used with the clamp 10, according to the preferred embodiment of the present invention.

Referring to FIG. 4, detailed perspective view of the securing clamp 100, as used with the clamp 10, according to the preferred embodiment of the present invention is depicted. The securing clamp 100 includes a rectangular frame 130 secured to the swivel joint 125, with remainder of the clamp omitted for clarity. The swivel joint 125 provides for a range of motion along two axes; the three hundred sixty-degree (360°) range of motion "e" 126 and the ninety-degree (90°) range of motion "b" 127. The ninety-degree (90°) range of motion "b" 127 is aided by an internal spring 161 (here shown by dashed lines due to its hidden state). The securing clamp 100 provides for two (2) swing clamps 150 that move along spring-loaded pivot points 155 to produce a dual arc travel path "a" 160. Such a feature allows the loose end 25 (a shown in FIG. 1) to be drawn through the securing clamp 100 (towards the user); however, any attempt by the loose end 25 to retract (away from the user) will cause it to become bound with the opening 135 between the swing clamps 150 and prevent retraction. This securing clamp 100 as shown in FIG. 4, is envisioned with use with small to medium diameter linear product 35 (as shown in FIG. 1).

Figure 5:
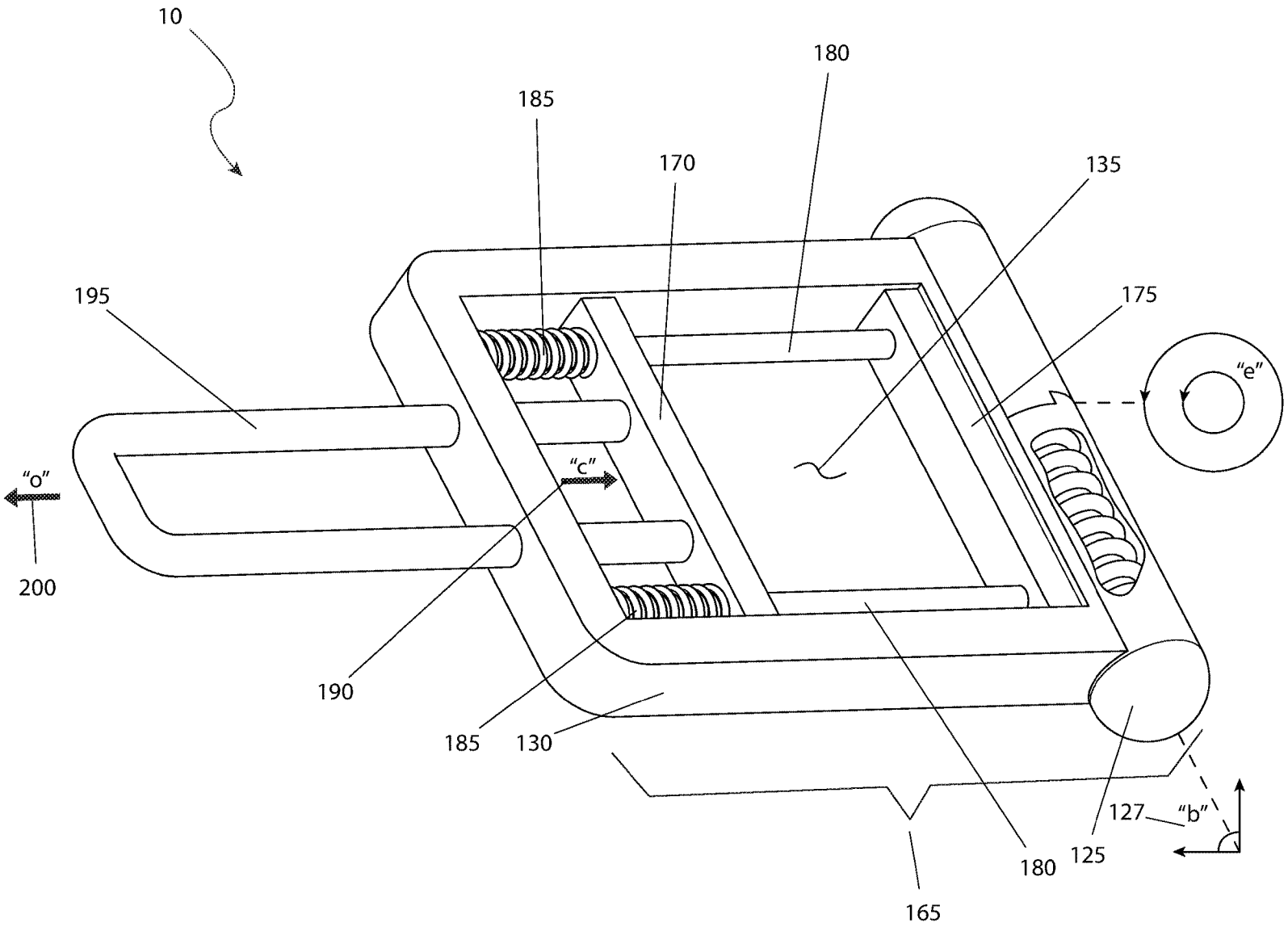
FIG. 5 is an alternate detailed view of the first alternate securing clamp 165, as used with the clamp 10, according to the preferred embodiment of the present invention; and, FIG. 6 is yet another alternate detailed view of the second alternate securing clamp 205, as used with the clamp 10, according to the preferred embodiment of the present invention.

Referring next to FIG. 5, an alternate detailed view of the first alternate securing clamp 165, as used with the clamp 10, according to the preferred embodiment of the present invention is disclosed. The first alternate securing clamp 165 is used in place of the securing clamp 100 (as shown in FIGS. 1, 2, 3, and 4) and is envisioned with use with medium to large diameter linear product 35 (as shown in FIG. 1). The first alternate securing clamp 165 is provided with a rectangular frame 130 that connects to the swivel joint 125 as before. The swivel joint 125 provides for a range of motion along two (2) axes; the three hundred sixty-degree (360°) range of motion "e" 126 and the ninety-degree (90°) range of motion "b" 127. The ninety-degree (90°) range of motion "b" 127 is aided by an internal spring 161 (here shown by dashed lines due to its hidden state).

The opening 135 is formed by a first movable plate 170 and a first stationary plate 175. The first movable plate 170 is positioned by two (2) guide rods 180. Two (2) springs 185 force the first movable plate 170 towards the first stationary plate 175, via travel along the guide rods 180 to thus secure the loose end 25 (as shown in FIG. 1) along a closing travel path "c" 190. To open the first alternate securing clamp 165 to release the loose end 25, the user would grab the release bar 195 and pull along an opening travel path "o" 200. A portion of the release bar 195 passes through the rectangular frame 130 and are attached to the first movable plate 170. The springs 185 are attached to the first movable plate 170 and the inner surface of the rectangular frame 130 and circumscribe a portion of the guide rods 180. The positing of the guide rods 180 are adjacent the inner surfaces of the rectangular frame 130, thus providing an adequate area for the loose end 25 to be secured therein.

Figure 6:
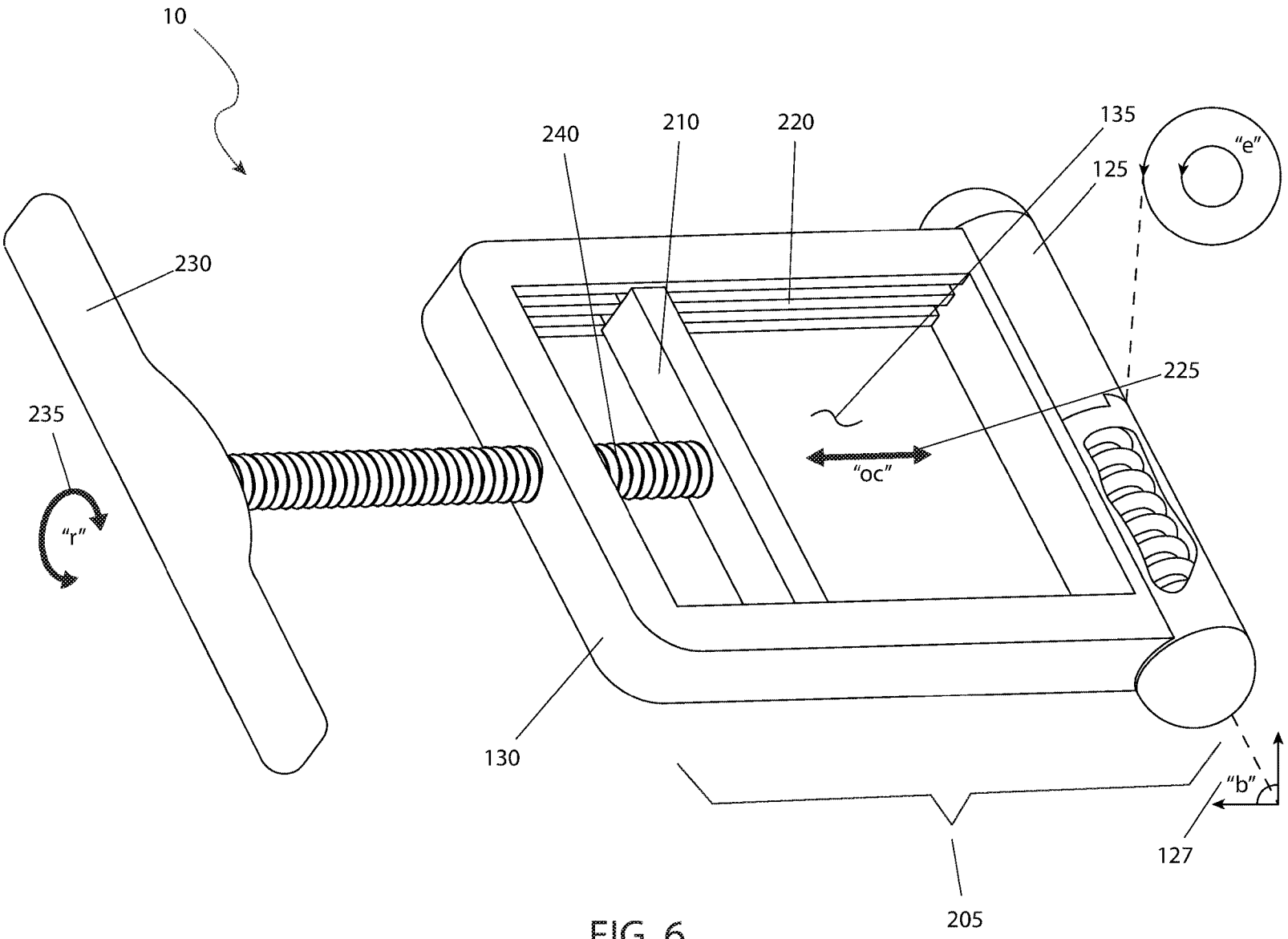

Referring to FIG. 6, yet another alternate detailed view of the second alternate securing clamp 205, as used with the clamp 10, according to the preferred embodiment of the present invention is shown. The second alternate securing clamp 205 is used in place of the securing clamp 100 (as shown in FIGS. 1, 2, 3, and 4) and is envisioned with use with large diameter linear product 35 (as shown in FIG. 1). The second alternate securing clamp 205 is provided with a rectangular frame 130 that connects to the swivel joint 125 as before. The swivel joint 125 provides for a range of motion along two axes; the three hundred sixty-degree (360°) range of motion "e" 126 and the ninety-degree (90°) range of motion "b" 127. The ninety-degree (90°) range of motion "b" 127 is aided by an internal spring 161 (here shown by dashed lines due to its hidden state). The opening 135 is formed by a second movable plate 210 and a second stationary plate 215. The second movable plate 210 is held in place by two (2) tracks 220 (of which only one (1) is shown due to illustrative limitations) on either side of the rectangular frame 130. The second movable plate 210 is driven along an open/close travel path "oc" 225 by turning of a thumbscrew 230 along a rotational travel path "r" 235. A threaded shaft 240 held captive in one axis to the second movable plate 210 at one (1) end, and captive to all axes as the thumbscrew 230, allows for movement of the second movable plate 210 to impinge upon the loose end 25 (as shown in FIG. 1) to hold it captive.

2. OPERATION OF THE PREFERRED EMBODIMENT

The preferred embodiment of the present invention can be utilized by the common user in a simple and effortless manner with little or no training. It is envisioned that the clamp 10 would be constructed in general accordance with FIG. 1 through FIG. 6. The user would procure the clamp 10 from conventional procurement sources such as home improvement stores, mechanical or electrical supply houses, mail order or internet-based retailers, or the like. Special attention would be paid to overall size of the reel 30 to be used with the clamp 10, material of construction of the flange 20 to be used with the clamp 10, and overall size (diameter) of the product clamp 60 to be used with the clamp 10, as well as the type of securing clamp 100, first alternate securing clamp 165 or second alternate securing clamp 205 to be used.

After procurement and prior to utilization, the clamp 10 would be prepared in the following manner: the clamp 10 would be applied to the flange 20 of the reels 30 at an appropriate location near the loose end 25 by placing the interior plate 110 on the interior side of the flange 20 and the exterior plate 115 on the exterior side of the flange 20 and attachment via the grip handle 145, thus adhering the clamp 10 to the reel 30. Next, the loose end 25 is routed through the opening 135 of either the securing clamp 100, the first alternate securing clamp 165 or the second alternate securing clamp 205 as appropriate. Next, using the swing clamps 155 of the securing clamp 100, the first movable plate 170 of the first alternate securing clamp 165, or the second movable plate 210 of the second alternate securing clamp 205, the loose end 25 is secured in place and remains in a stable location until further quantity of the linear product 35 is needed at a future time.

To remove the loose end 25, it may simple be pulled through the securing clamp 100. In the case of the first alternate securing clamp 165, the user must pull the release bar 195 along the opening travel path "o" 200 to release the first movable plate 170. In the instance of the second alternate securing clamp 205, the user must loosen the thumbscrew 230, to turn the threaded shaft 240 and release the second movable plate 210. In any of the three instances, the needed length of linear product 35 is unreeled as needed. Upon cutting, the clamp 10 is repositioned along the flange 20 if needed, and the new loose end 25 is retained as described above.

Should the complete quantity of linear product 35 be utilized from the reel 30, the clamp 10 may be removed and used on other reels 30 as needed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A clamp mounted to an exterior perimeter of a flange of a reel, comprising:

a securing clamp securing a loose end of a linear product wound on the reel within the securing clamp, the securing clamp includes a rectangular frame with an interior opening through which the loose end of a linear product passes and is restrained from unwinding or becoming loose;

a swivel joint incorporated as part of a junction between the securing clamp and an attachment clamp;

an opening formed by a movable plate and a stationary plate, the movable plate is positioned by a pair of guide rods; and a pair of springs forcing the movable plate towards the stationary plate via travel along the guide rods to secure the loose end along a closing travel path;

wherein to open the securing clamp to release the loose end, a user would grab a release bar and pull along an opening travel path, a portion of the release bar passes through the rectangular frame and is attached to the movable plate, the pair of springs are attached to the movable plate and the inner surface of the rectangular frame and circumscribe a portion of the guide rods, the positing of the guide rods are adjacent the inner surfaces of the rectangular frame, thus providing an adequate area for the loose end to be secured therein.

2. The clamp according to claim 1, wherein a pair of clamping mechanisms are secured by a plurality of fasteners.

3. The clamp according to claim 1, wherein the swivel joint accommodates a first range of motion of three hundred sixty-degrees perpendicular to a clamping face and a second range of motion of ninety-degrees parallel to the clamping face.

4. The clamp according to claim 3, wherein the second range of motion is aided by an internal spring.

* * * * *